United States Patent [19]

Ritten

[11] Patent Number: 4,768,618

[45] Date of Patent: Sep. 6, 1988

[54] BOAT LADDER DEVICES WITH STEP STANDOFF FEATURE

[75] Inventor: Robert G. Ritten, Ft. Pierce, Fla.

[73] Assignee: Step-On Inc., Ft. Pierce, Fla.

[21] Appl. No.: 149,472

[22] Filed: Jan. 28, 1988

[51] Int. Cl.[4] ..... B63B 27/14

[52] U.S. Cl. ..... 182/86; 182/91; 182/97; 182/106; 114/343

[58] Field of Search ..... 182/90, 91, 92, 93, 182/86, 106; 114/343, 362, 363, 364

[56] References Cited

U.S. PATENT DOCUMENTS

| | | | |
|---|---|---|---|
| 3,195,680 | 7/1965 | Thornburg | 182/92 |
| 3,586,124 | 6/1971 | Kunzweiler | 182/106 |
| 3,774,720 | 11/1973 | Hovey | 182/91 |
| 3,794,140 | 2/1974 | Sell | 182/106 |
| 3,964,572 | 6/1976 | Gannon | 182/86 |
| 3,991,851 | 11/1976 | Gannon | 182/86 |
| 4,462,485 | 7/1984 | Terry et al. | 182/91 |
| 4,712,503 | 12/1987 | Ritten | 114/343 |
| 4,722,419 | 2/1988 | Hoszowski | 182/86 |
| 4,726,317 | 2/1988 | Ritten | 182/91 |
| 4,735,285 | 4/1988 | Ritten | 182/91 |

*Primary Examiner*—Reinaldo P. Machado
*Attorney, Agent, or Firm*—Carroll F. Palmer

[57] ABSTRACT

A ladder device for a boat has a mount unit and a separate step unit that may be moved between a use position with a step thereof immersed in the water in which the boat floats and a storage position where the step is located out of the water. The step in the use position extends aft of the platform and permits a person to climb out of the water and onto the platform without the step making any appreciable movement relative to the boat during such climb. The mount unit has a pair of U-shaped members formed of a section of tubing with first and second ends and a transverse flange is fixed to each first end by which the members may be attached to the upper surface of the platform. The step unit has two parallel S-shaped tubular side sections, each including a long central portion from which upper and lower end portions extend integrally and substantially normally. A step is fixed at its ends to the lower end portions holding the side sections spaced apart from each other. The step unit is pinned to the mount unit for movement of the step unit between the use position and the storage position. Several multistep embodiments are disclosed.

6 Claims, 1 Drawing Sheet

BOAT LADDER DEVICES WITH STEP STANDOFF FEATURE

BACKGROUND OF THE INVENTION

1. Field of the Invention

This invention relates broadly to ladder devices for boats having a step standoff feature. More particularly, it concerns ladders for attachment to a transom platform or other portion of boats having a step unit that may be moved between a use position with a step thereof immersed in the water in which the boat floats and a storage position where the step is located out of the water, which step when in the use position extends outward of the platform or other part of the boat and permits a person to climb out of the water and onto the boat without the step making any appreciable movement.

2. Description of the Prior Art

A variety of platform and step devices have been developed and marketed for attachment to the transoms of boats to assist in boarding or debarking the boats or to help in moving or working about the boats. Such devices can be divided broadly into three classes, i.e., (1) those that are strictly ladders and provide no real platform function (see U.S. Pat. No. 3,774,720), (2) those that are strictly platforms and (3) those that can provide combination step and platform functions (see U.S. Pat. Nos. 3,195,680 and 4,462,485). The present invention relates the devices of the third type.

In the devices of the third type in the prior art there is typically a platform that attaches to the boat transom plus some form of depending step arrangement that assists the user of the device to lower or raise his body upon one or more steps positioned at a level below the platform. In some forms of such devices, the depending step or steps are fixed immoveably to the platform while in others the step or steps are hinged or otherwise arranged to move between a lowered, use position and a raised, storage position. The present invention concerns boat ladder devices of the moveable step type.

The prior art devices of the type to which the present invention relates as stated above have some undesirable aspects. For example, many such type prior art devices have a moveable step section mounted to the platform section in a manner that the step section is not sturdily fixed when in the lowered, use position with the result that the user has difficulty in lifting his body on an unsteady step. This is particularly bothersome when the user is carrying heavy gear, e.g., scuba gear, since the added weight serves to aggravate the unstable conditions. The present invention provides ladder devices that eliminate this type of boat step problems.

OBJECTS

A principal object of the invention is the provision of improved forms of ladder devices for attachment to boats.

Further objects include the provision of:

1. Ladder devices for transom platforms of boats having moveable step sections in which the step section when in the lowered, use position is fixed against swinging or other movement relative to the platform to which attached so a user is presented with steady step or steps upon which to lift his body and any gear that he carries.

2. Ladder devices for boat transom platforms having a step unit that may be easily disconnected for stowage aboard the boat.

3. New boat ladder devices having improved safety and function features.

4. Such devices structured to minimize material and labor costs in their manufacture.

Other objects and further scope of applicability of the present invention will become apparent from the detailed description given hereinafter; it should be understood, however, that the detailed description, while indicating preferred embodiments of the invention, is given by way of illustration only, since various changes and modifications within the spirit and scope of the invention will become apparent to those skilled in the art from this detailed description.

SUMMARY OF THE INVENTION

The objects of the invention are accomplished, in part, by the provision of improved ladder devices for the transom platforms of boats that comprise a mount unit and a step unit that may be moved between a use position with a step thereof immersed in the water in which the boat floats and a storage position where the step is located out of the water. Such step in the use position extends aft of the platform and permits a person to climb out of the water and onto the platform without the step making any appreciable movement relative to the platform during such climb.

In the improved ladder devices, the mount unit comprises a pair of U-shaped members formed of a section of tubing with first and second ends. A transverse flange is fixed to each first end by which the members may be attached to the upper surface of the platform or other part of a boat. The second ends are free and unattached.

There is a first transverse hole in the first end of each of the U-shaped members adjacent the flange.

The step unit has two parallel S-shaped tubular side sections, each of which includes a long central portion from which upper and lower end portions extend integrally and substantially normally.

There is a second transverse hole in the end of each of upper end portion of the side sections.

A step is fixed at its ends to the lower end portions of the side sections holding them spaced apart from each other.

A pair of pins extend through a hole of the mount unit and a hole of the step unit pinning the step unit to the mount unit for movement of the step unit between the use position and the storage position.

In preferred embodiments of the improved ladder devices, the steps are flat and made of wood. Also, the step unit may include steps other than one step that are mounted on the long central portion of the side sections.

In one embodiment of the new ladders, a telescoping step section is provided the permits the ladder to shorten in length when the step section is raised into the storage mode and lengthen when such section is lowered into the use mode.

In the installation of the improved ladder devices, the mount unit is fixed by fasteners so that its flanges are positioned fore of the aft end of the platform a distance such that, when the step unit is in the use position, its side sections engage the aft end in a manner that the lower step extends a substantial distance aft of the platform, i.e., the aft end of the platform acts as a stop to limit downward movement of the step unit and provide the support needed to keep the steps of the device outboard of the aft end of the platform.

In addition to mounting on a stern platform, the new ladders of the invention may be mounted on other parts of a boat, e.g., the upper deck adjacent a gunwale.

BRIEF DESCRIPTION OF THE DRAWINGS

A more complete understanding of the invention may be had by reference to the accompanying drawings in which.

DESCRIPTION OF THE PREFERRED EMBODIMENTS

Figure 2:
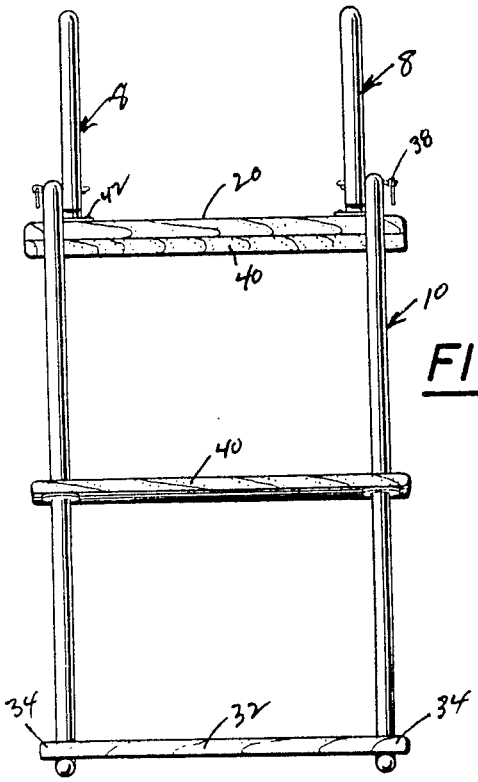
FIG. 2 is an end view of the ladder device of FIG. 1.

Referring in detail to the drawings, in which identical parts are identically marked, the invention comprises a ladder device 2 for the transom platform 4 of a boat 6 having a mount unit 8 and a step unit 10.

The mount unit 8 comprises a pair of U-shaped members 12 formed of a section of tubing with first end 14 and second end 16.

A transverse flange 18 is fixed to each first end 14 by which the members 12 may be attached to the upper surface 20 of the platform 4.

The second ends 16 are free and unattached and there is first transverse hole (not shown) in the first end 14 of each the U-shaped member 12 adjacent the flange 18.

The step unit 10 comprises two parallel S-shaped tubular side sections 22, each including a long central portion 24 from which upper end portion 26 and lower end portion 28 extend integrally and substantially normally.

There is second transverse hole (not shown) in the end 30 of each upper end portion.

A lower step 32 is fixed at its ends 34 to the lower end portions 28 holding the side sections 22 spaced apart from each other. The step 32 is essentially flat and contains a pair of parallel grooves 36 to provide an anti-slip feature. The step 32 is illustrated as being made of wood, but may be made of metal, molded plastic, etc.

A pair of pins 38 that extend through the first and second holes pinning the step unit to the mount unit for movement of the step unit between the use position and the storage position.

Figure 4:
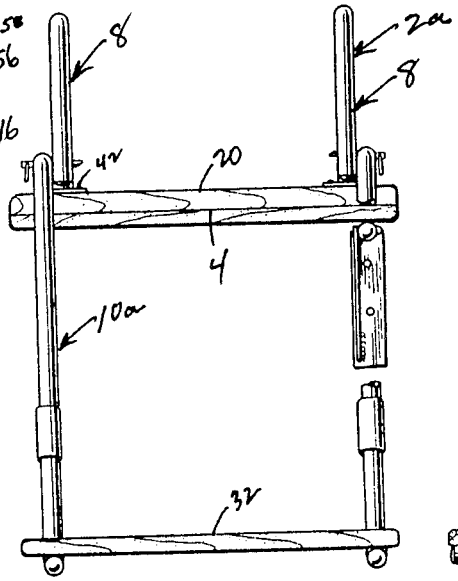
FIG. 4 is an end view of the ladder device of FIG. 3.

The ladder device 2 of FIGS. 1, 2, 5 & 6 have an additional step 40. The ladder device **2*a* of FIGS. 3 & 4 has only a lower step 32 fixed to a shorter step unit 10*a* comprising central portion 24*a*, upper end portion 26*a* and lower end portion 28*a***.

Figure 1:
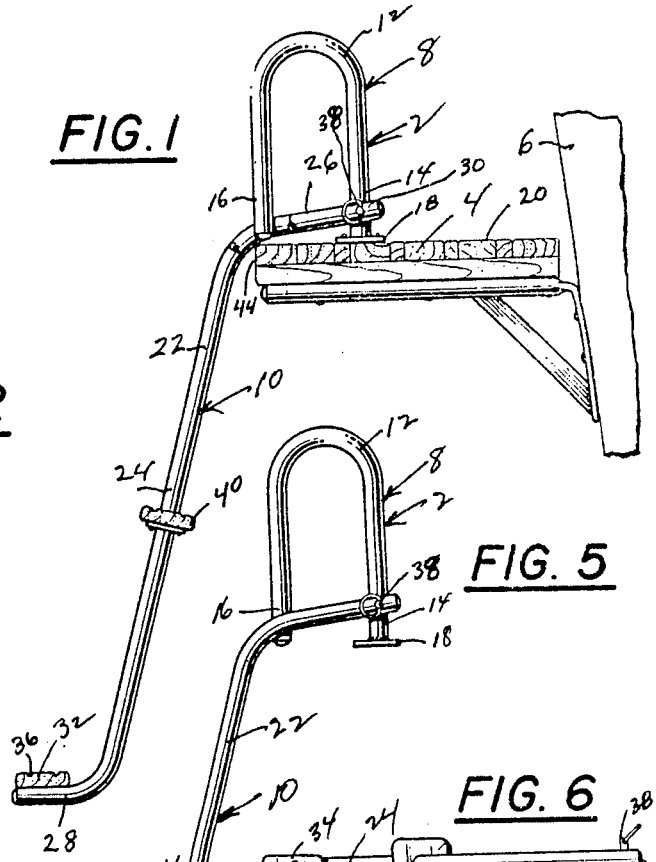
FIG. 1 is a lateral view of a first embodiment of a ladder device of the invention mounted on a boat transom platform.
Figure 5:
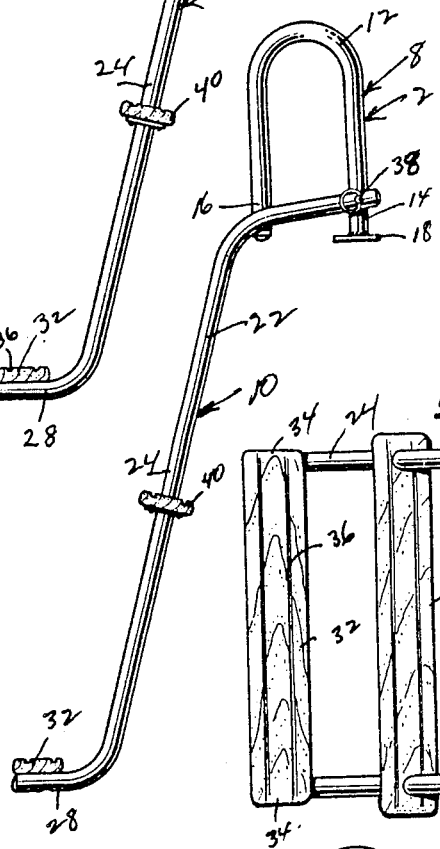
FIG. 5 is a lateral view of the unmounted ladder device of FIG. 1.
Figure 6:
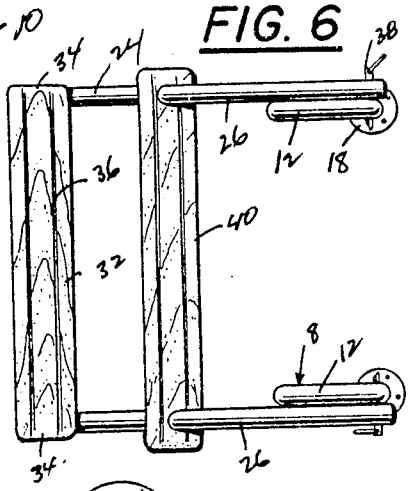
FIG. 6 is a plan view corresponding to FIG. 5.
Figure 3:
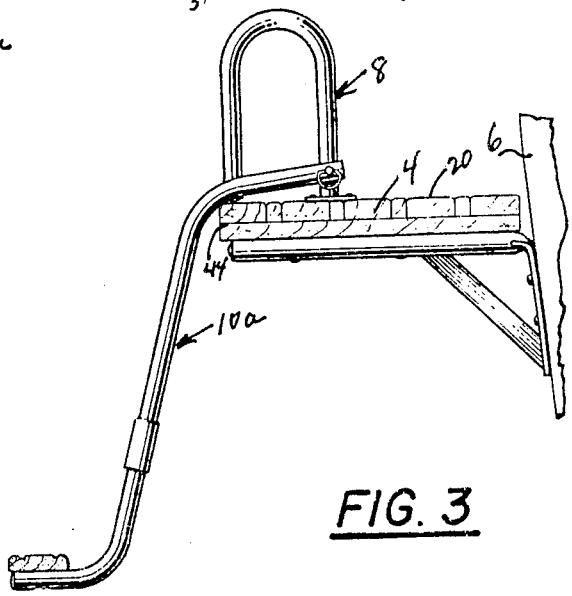
FIG. 3 is a lateral view of a second embodiment of a ladder device of the invention mounted on a boat transom platform.

The mount unit 8 are fixed by fasteners 42 that extend through the flanges 18 into the platform 4 so the flanges 18 are positioned fore of the aft ends 44 of the platform 4 a distance such that, when the step unit is in the use position as shown in FIGS. 1 & 3, the side sections 10 & **10*a* engage the aft end in a manner that the lower step 32 extends a substantial distance aft of the platform 4**.

Figure 7:
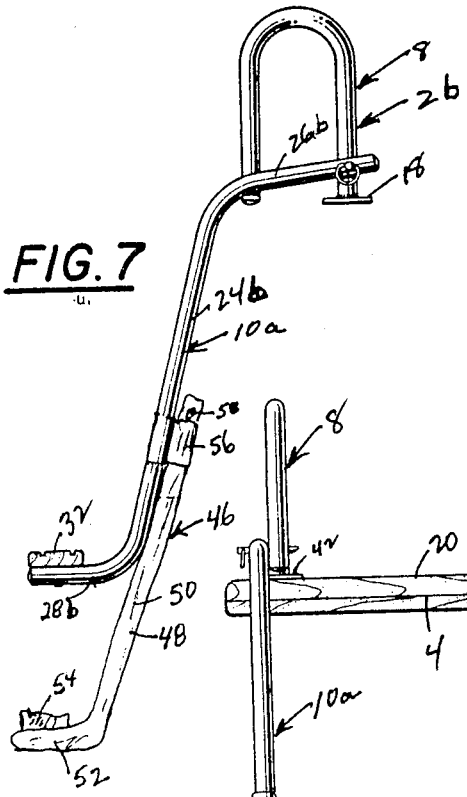
FIG. 7 is a lateral view of an embodiment of the new ladders having a telescoping step section.

FIG. 7 shows a ladder device **2*b* of the invention having a telescoping portion 46 in its step section 10*b* which includes a pair of J-shaped tubular members 48 comprising a straight leg portion 50 and a foot portion 52 to which a step 54 is fixed. The portion 46 is supported on the central portion 24*b* by the tubular collar 56 welded to the portion 24*b*. A pin 58 keeps the leg portion 50 from falling out of the collar 58 when the leg portion 10*b* is in the lowered, use mode of the ladder device 2*b***.

The telescoping portion 46 extends the length of the ladder device **2*b* when the step section 10*b* is in the lowered, use position as shown in FIG. 7, but when the step section 10*b*** is raised into the storage mode (not shown), the portion telescopes into a space-saving configuration.

While the new ladder devices of the invention has been shown in the drawings as being mounted on a stern platform of the boat 6, it is possible to mount then in other positions and on other parts of a boat provided the flanges 18 are positioned away form the edge, such as platform end 44, that will engage the step unit 10 or **10*a* in a manner as shown in FIGS. 1 & 3**.

The embodiments of the invention in which an exclusive property or privilege is claimed are defined as follows:

1. In a ladder device for the transom platform of a boat having a mount unit and a step unit that may be moved between a use position with a step thereof immersed in the water in which the boat floats and a storage position where said step is located out of said water, which step in said use position extends aft of said platform and permits a person to climb out of said water and onto said platform without said step making any appreciable movement relative to said platform during such climb, the improvement wherein:

said mount unit comprises:

a pair of U-shaped members formed of a section of tubing with first and second ends, a transverse flange fixed to each said first end by which said members may be attached to the upper surface of said platform, said second end being free and unattached and a first transverse hole in the first end of each said U-shaped member adjacent said flange, said step unit comprises:

two parallel S-shaped tubular side sections each including a long central portion from which upper and lower end portions extend integrally and substantially normally, a second transverse hole in the end of each said upper end portion, and a step fixed at its ends to said lower end portions holding said side sections spaced apart from each other, and a pair of pins that extend through said first and second holes pinning said step unit to said mount unit for movement of said step unit between said use position and said storage position.

2. The ladder device of claim 1 wherein said step is flat.

3. The ladder device of claim 2 wherein said step is made of wood.

4. The ladder device of claim 1 wherein said step unit includes steps other than said step fixed to said lower end portion that are mounted on said long central portion of said side sections.

5. The ladder device of claim 1 wherein said mount unit is fixed by fasteners that extend through said flanges into said platform so said flanges are positioned fore of the aft end of said platform a distance such that, when said step unit is in said use position, said side sections engage said aft end in a manner that said lower step extends a substantial distance aft of said platform.

6. The ladder device of claim 1 that has a telescoping portion in its step section which includes a pair of J-shaped tubular members to which a step is fixed, said telescoping portion being supported on said central portion by a tubular collar fixed to said central portion whereby said telescoping portion extends the length of the ladder device when said step section is in the lowered, use position and telescopes into a space-saving configuration when said step section is raised into a raised, storage mode.

* * * * *